US011682341B2

(12) United States Patent
Watsuda

(10) Patent No.: US 11,682,341 B2
(45) Date of Patent: Jun. 20, 2023

(54) LIGHT EMITTING DEVICE AND LIGHT EMITTING METHOD

(71) Applicant: Innolux Corporation, Miao-Li County (TW)

(72) Inventor: Hirofumi Watsuda, Miao-Li County (TW)

(73) Assignee: Innolux Corporation, Miaoli County (TW)

( * ) Notice: Subject to any disclaimer, the term of this patent is extended or adjusted under 35 U.S.C. 154(b) by 14 days.

(21) Appl. No.: 17/375,004

(22) Filed: Jul. 14, 2021

(65) Prior Publication Data

US 2023/0027951 A1 Jan. 26, 2023

(51) Int. Cl.
*G09G 3/32* (2016.01)
*G09G 3/20* (2006.01)

(52) U.S. Cl.
CPC ..... *G09G 3/32* (2013.01); *G09G 3/2074* (2013.01); *G09G 2300/0814* (2013.01); *G09G 2310/027* (2013.01)

(58) Field of Classification Search
CPC ..... G09G 3/32; G09G 3/2074
See application file for complete search history.

(56) References Cited

U.S. PATENT DOCUMENTS

2015/0348464 A1* 12/2015 In ..... G09G 3/2022 345/82
2018/0182279 A1 6/2018 Sakariya et al.
2020/0111404 A1 4/2020 Kim et al.
2020/0234632 A1* 7/2020 Lee ..... G09G 3/325
2020/0312229 A1* 10/2020 Kim ..... G09G 3/32
2021/0049957 A1 2/2021 Lee
2021/0375193 A1* 12/2021 Son ..... G09G 3/32

FOREIGN PATENT DOCUMENTS

CN 111477165 7/2020

OTHER PUBLICATIONS

"Search Report of Europe Counterpart Application", dated Dec. 1, 2022, p. 1-p. 13.

* cited by examiner

*Primary Examiner* — Nelson M Rosario
*Assistant Examiner* — Scott Au
(74) *Attorney, Agent, or Firm* — JCIPRNET

(57) ABSTRACT

A light emitting device and a light emitting method are provided. The light emitting device includes a plurality of sub-pixels. Each of the sub-pixels displays a grayscale during a frame. The frame includes N sub-frames. Each of the sub-frames include a scan period and an emission period. Each of the sub-pixels include a pixel circuit and a light emitter. The pixel circuit include a current control circuit and a pulse width modulation (PWM) circuit. The current control circuit receives an analog signal, and outputs a driving current according to the analog signal. The PWM circuit receives M digital signals and M reference pulse signals, and outputs a PWM pulse according to the M digital signals and the M reference pulse signals. The light emitter receives the driving current and the PWM pulse during emission period of each of the N sub-frames.

18 Claims, 16 Drawing Sheets

| | | | | | |
|---|---|---|---|---|---|
| A | A | A | A | A | A |
| B | B | B | B | B | B |
| C | C | C | C | C | C |
| A | A | A | A | A | A |
| B | B | B | B | B | B |
| C | C | C | C | C | C |

FIG. 6D

| | | | | | |
|---|---|---|---|---|---|
| A | B | C | A | B | C |
| A | B | C | A | B | C |
| A | B | C | A | B | C |
| A | B | C | A | B | C |
| A | B | C | A | B | C |
| A | B | C | A | B | C |

FIG. 6E

| | | | | | |
|---|---|---|---|---|---|
| A | B | C | A | B | C |
| B | C | A | B | C | A |
| C | A | B | C | A | B |
| A | B | C | A | B | C |
| B | C | A | B | C | A |
| C | A | B | C | A | B |

FIG. 6F

LIGHT EMITTING DEVICE AND LIGHT EMITTING METHOD

BACKGROUND

Technical Field

The disclosure relates to a light emitting device; particularly, the disclosure relates to a light emitting device and a light emitting method.

Description of Related Art

Current control is commonly used for generating a variety of currents for pixels to display a plurality of levels of grayscales. However, as the requirement of levels of grayscales increases, the scale of the driving circuit increases as well.

SUMMARY

The disclosure is directed to a light emitting device and a light emitting method capable of providing a good display effective.

In the disclosure, the light emitting device may include a plurality of sub-pixels. Each of the sub-pixels is configured to display a grayscale during a frame. The frame may include N sub-frames. Each of the sub-frames may include a scan period and an emission period. Each of the sub-pixels may include a pixel circuit and a light emitter. The pixel circuit may include a current control circuit and a pulse width modulation (PWM) circuit. The current control circuit is configured to receive an analog signal during the scan period and to output a driving current according to the analog signal during the emission period. The PWM circuit is configured to receive M digital signals and M reference pulse signals and to output a PWM pulse according to the M digital signals and the M reference pulse signals. The light emitter is configured to receive the driving current and the PWM pulse during the emission period of each of the N sub-frames. N and M are integers greater than 1.

In the disclosure, the light emitting may include steps of receiving, through the current control circuit, an analog signal during the scan period, outputting, through the current control circuit, a driving current according to the analog signal during the emission period, receiving, through the PWM circuit, M digital signals and M reference pulse signals, outputting, through the PWM circuit, a PWM pulse according to the M digital signals and the M reference pulse signals, and receiving, by the light emitter, the driving current and the PWM pulse during the emission period of each of the N sub-frames. N and M are integers greater than 1.

Based on the above, according to the light emitting device and the light emitting method of the disclosure, a variety of grayscales may be formed according to a plurality of combinations of the amount of the driving current and the width of the PWM pulse. Moreover, as the requirement of levels of grayscales increases, the scale of the driving circuit of the disclosure can remain relatively small.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

FIG. 6D is a schematic sub-pixels arrangement according to fourth embodiment of the disclosure.

FIG. 6E is a schematic sub-pixels arrangement according to fourth embodiment of the disclosure.

FIG. 6F is a schematic sub-pixels arrangement according to fourth embodiment of the disclosure.

DESCRIPTION OF THE EMBODIMENTS

Figure 1A:
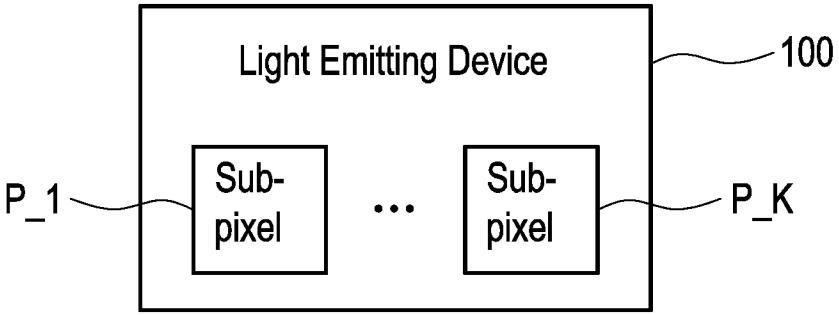
FIG. 1A is a schematic block diagram of a light emitting device according to an embodiment of the disclosure.

Reference will now be made in detail to the exemplary embodiments of the disclosure, examples of which are illustrated in the accompanying drawings. Whenever possible, the same reference numbers are used in the drawings and the description to refer to the same or like components.

Certain terms are used throughout the specification and appended claims of the disclosure to refer to specific components. Those skilled in the art should understand that electronic device manufacturers may refer to the same components by different names. This article does not intend to distinguish those components with the same function but different names. In the following description and rights request, the words such as "comprise" and "include" are open-ended terms, and should be explained as "including but not limited to . . . ".

The term "coupling (or connection)" used throughout the whole specification of the present application (including the appended claims) may refer to any direct or indirect connection means. For example, if the text describes that a first device is coupled (or connected) to a second device, it should be interpreted that the first device may be directly connected to the second device, or the first device may be indirectly connected through other devices or certain connection means to be connected to the second device. The terms "first", "second", and similar terms mentioned throughout the whole specification of the present application (including the appended claims) are merely used to name discrete elements or to differentiate among different embodiments or ranges. Therefore, the terms should not be regarded as limiting an upper limit or a lower limit of the quantity of the elements and should not be used to limit the arrangement sequence of elements. In addition, wherever possible, elements/components/steps using the same reference numerals in the drawings and the embodiments represent the same or similar parts. Reference may be mutually made to related descriptions of elements/components/steps using the same reference numerals or using the same terms in different embodiments.

The light emitting device of the disclosure may, for example, be adapted to a liquid crystal, a light emitting diode, a quantum dot (QD), a fluorescence, a phosphor, other suitable display medium, or the combination of the aforementioned material, but the disclosure is not limited thereto. The light emitting diode may include, for example, organic light emitting diode (OLED), sub-millimeter light emitting diode (Mini LED), micro light emitting diode (Micro LED), or quantum dot light emitting diode (QLED) or other suitable materials. The materials may be arranged and combined arbitrarily, but the disclosure is not limited to thereto. The light emitting device of the disclosure may include peripheral systems such as driving system, control system, light source system, shelf system, and the like to support the light emitting device.

It should be noted that in the following embodiments, the technical features of several different embodiments may be replaced, recombined, and mixed without departing from the spirit of the disclosure to complete other embodiments. As long as the features of each embodiment do not violate the spirit of the disclosure or conflict with each other, they may be mixed and used together arbitrarily.

FIG. 1A is a schematic block diagram of a light emitting device according to an embodiment of the disclosure. Referring to FIG. 1A, a light emitting device 100 may include a plurality of sub-pixels P_1~P_K, where K is an integer greater than 1. Each of the sub-pixels P_1~P_K is configured to display a grayscale during a frame. Further, the frame may include N sub-frames, where N is an integer greater than 1. Furthermore, each of the N sub-frames may include a scan period and an emission period, but the disclosure is not limited thereto. In the embodiment, the light emitting device 100 may, for example, be particularly suitable for an active matrix LED (AM-LED) display.

Figure 1B:
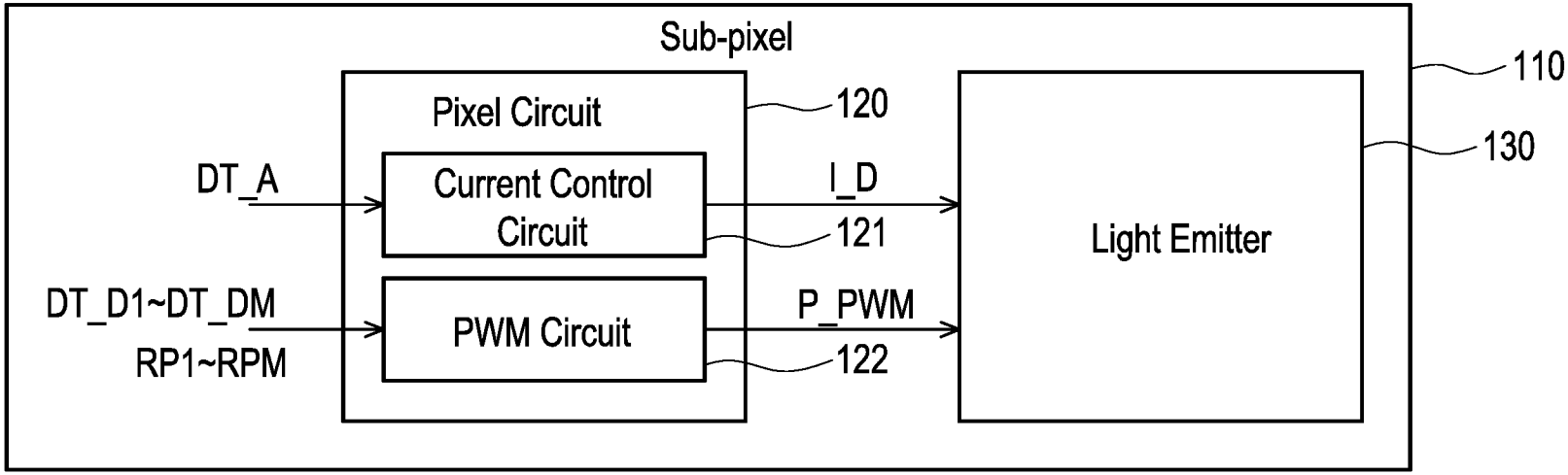
FIG. 1B is a schematic block diagram of a sub-pixel according to an embodiment of the disclosure.

FIG. 1B is a schematic block diagram of a sub-pixel according to an embodiment of the disclosure. Referring to FIG. 1A and FIG. 1B, the sub-pixel 110 is an exemplary embodiment of the sub-pixels P_1~P_K. Specifically, the sub-pixel 110 may include a pixel circuit 120 and a light emitter 130. Further, the pixel circuit 120 may include a current control circuit 121 and a pulse width modulation (PWM) circuit 122. The current control circuit 121 is configured to receive an analog signal DT_A during the scan period, and to output a driving current I_D according to the analog signal DT_A during the emission period. The PWM circuit 122 is configured to receive M digital signals DT_D1~DT_DM and M reference pulse signals RP1~RPM, and to output a PWM pulse P_PWM according to the M digital signals DT_D1~DT_DM and the M reference pulse signals RP1~RPM. M is an integer greater than 1. The light emitter 130 is configured to receive the driving current I_D and the PWM pulse P_PWM during the emission period. That is, a variety of grayscales may be formed according to a plurality of combinations of the amount of the driving current I_D and the width of the PWM pulse P_PWM. Therefore, as the requirement of levels of grayscales increases, the scale of the driving circuit remains relatively small.

Figure 2:
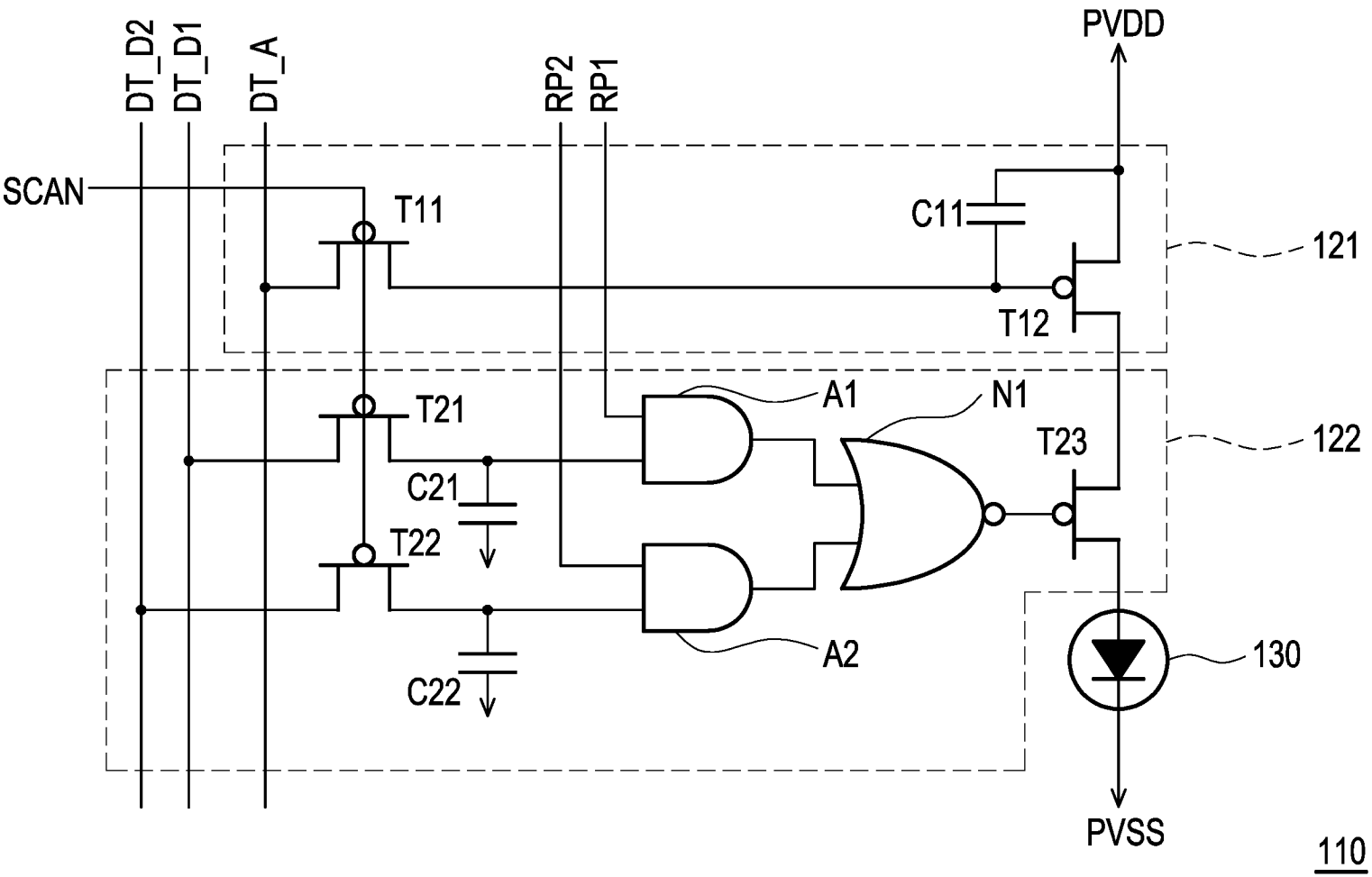
FIG. 2 is a schematic circuit diagram of a sub-pixel according to an embodiment of the disclosure.

FIG. 2 is a schematic circuit diagram of a sub-pixel according to an embodiment of the disclosure. Referring to FIG. 1A to FIG. 2, in one embodiment, the sub-pixel 110 may be shown as FIG. 2, but the disclosure is not limited thereto. For example, N is assumed to be 3 and M is assumed to be 2, but the disclosure is not limited thereto. That is, the sub-pixel 110 is configured to display a grayscale during a frame and the frame may include three sub-frames. Each of the three sub-frames may include a scan period and an emission period. Further, the PWM circuit 122 is configured to receive two digital signals DT_D1, DT_D2 and two reference pulse signals RP1, RP2. Furthermore, the PWM circuit 122 is configured to output a PWM pulse P_PWM according to the two digital signals DT_D1, DT_D2 and the two reference pulse signals RP1, RP2.

Specifically, the current control circuit 121 may include a transistor T11, a transistor T12, and a capacitor C11. A first terminal of the transistor T11 is coupled to an analog signal DT_A and a control terminal of the transistor T11 is coupled to a scan signal SCAN. A control terminal of the transistor T12 is coupled to a second terminal of the transistor T11 and a first terminal of the transistor T12 is coupled to a voltage source PVDD. A first terminal of the capacitor C11 is coupled to the control terminal of the transistor T12 and a second terminal of the capacitor C11 is coupled to the first terminal of the transistor T12. In the embodiment, the control terminal may be a gate terminal of the transistors T11, T12 and the first terminal and the second terminal may be the source terminal and drain terminal, respectively, but the disclosure is not limited thereto. The scan signal SCAN is provided to each of the K sub-pixels P_1~P_K to determine the sequence of light emitting of the K sub-pixels P_1~P_K. That is, the current control circuit 121 is configured to receive the analog signal DT_A during the scan period and to output the driving current I_D according to the analog signal DT_A during the emission period.

Further, the PWM circuit 122 may include a transistor T21, a transistor T22, a transistor T23, a capacitor C21, a capacitor C22, a AND gate A1, a AND gate A2, and a NOR gate N1. A first terminal of the transistor T21 is coupled to a digital signal DT_D1 and a control terminal of the transistor T21 is couple to the scan signal SCAN. A first terminal of the transistor T22 is coupled to a digital signal DT_D2 and a control terminal of the transistor T22 is couple to the scan signal SCAN. A first terminal of the capacitor C21 is coupled to a second terminal of the transistor T21 and a second terminal of the capacitor C21 is coupled to a ground voltage. A first terminal of the capacitor C22 is coupled to a second terminal of the transistor T22 and a second terminal of the capacitor C22 is coupled to the ground voltage. A first input terminal of the AND gate A1 is coupled to a reference pulse signal RP1 and a second input terminal of the AND gate A1 is coupled to the second terminal of the transistor T21. A first input terminal of the AND gate A2 is coupled to a reference pulse signal RP2 and a second input terminal of the AND gate A2 is coupled to the second terminal of the transistor T22. A first input terminal of the NOR gate N1 is coupled to an output terminal of the AND gate A1 and a second input terminal is coupled to an output terminal of the AND gate A2. A control terminal of the transistor T23 is coupled to an output terminal of the NOR gate N1 and a first terminal of the transistor T23 is coupled to a second terminal of the transistor T12. Specifically, the transistor T21 is configured to receive the digital signal DT_D1 and to output the digital signal DT_D1 to the AND gate A1. The transistor T22 is configured to receive the digital signal DT_D2 and to output the digital signal DT_D2 to the AND gate A2.

In the embodiment, the two digital signals DT_D1, DT_D2 and the two reference pulse signals RP1, RP2 may include a plurality of reference pulses. The reference pulses may include different widths and different voltage levels. When the voltage levels of the digital DT_D1 and the reference pulse signal RP1 are both at a high level, the AND gate A1 may output a logic operation result to the NOR gate N1. When the voltage levels of digital DT_D1 and the reference pulse signal RP1 are both not at the high level, the AND gate A1 may not output a logic operation result to the NOR gate N1. Therefore, the PWM circuit 122 may output a pulse P_PWM according to the digital signal DT_D1 and the reference pulse signal RP1. Similarly, when voltage levels of the digital DT_D2 and the reference pulse signal RP2 are both at the high level, the AND gate A2 may output a logic operation result to the NOR gate N1. When the voltage levels of digital DT_D2 and the reference pulse signal RP2 are both not at the high level, the AND gate A2 may not output a logic operation result to the NOR gate N1. Therefore, the PWM circuit 122 may output a pulse P_PWM according to the digital signal DT_D2 and the reference pulse signal RP2. In this manner, the PWM circuit 122 is configured to output a PWM pulse P_PWM according to the two digital signals DT_D1 and DT_D2 and the two reference pulse signals RP1 and RP2.

Furthermore, a first terminal of the light emitter 130 is coupled to a second terminal of the transistor T23, and a second terminal of the light emitter 130 is coupled to a voltage source PVSS. Therefore, the light emitter 130 is configured to receive the driving current I_D and the PWM pulse P_PWM during the emission period. That is, a variety of grayscales may be formed according to a plurality of combinations of the amount of the driving current I_D and the width of PWM pulse P_PWM. Therefore, as the requirement of levels of grayscales increases, the scale of the driving circuit remains relatively small.

Figure 3:
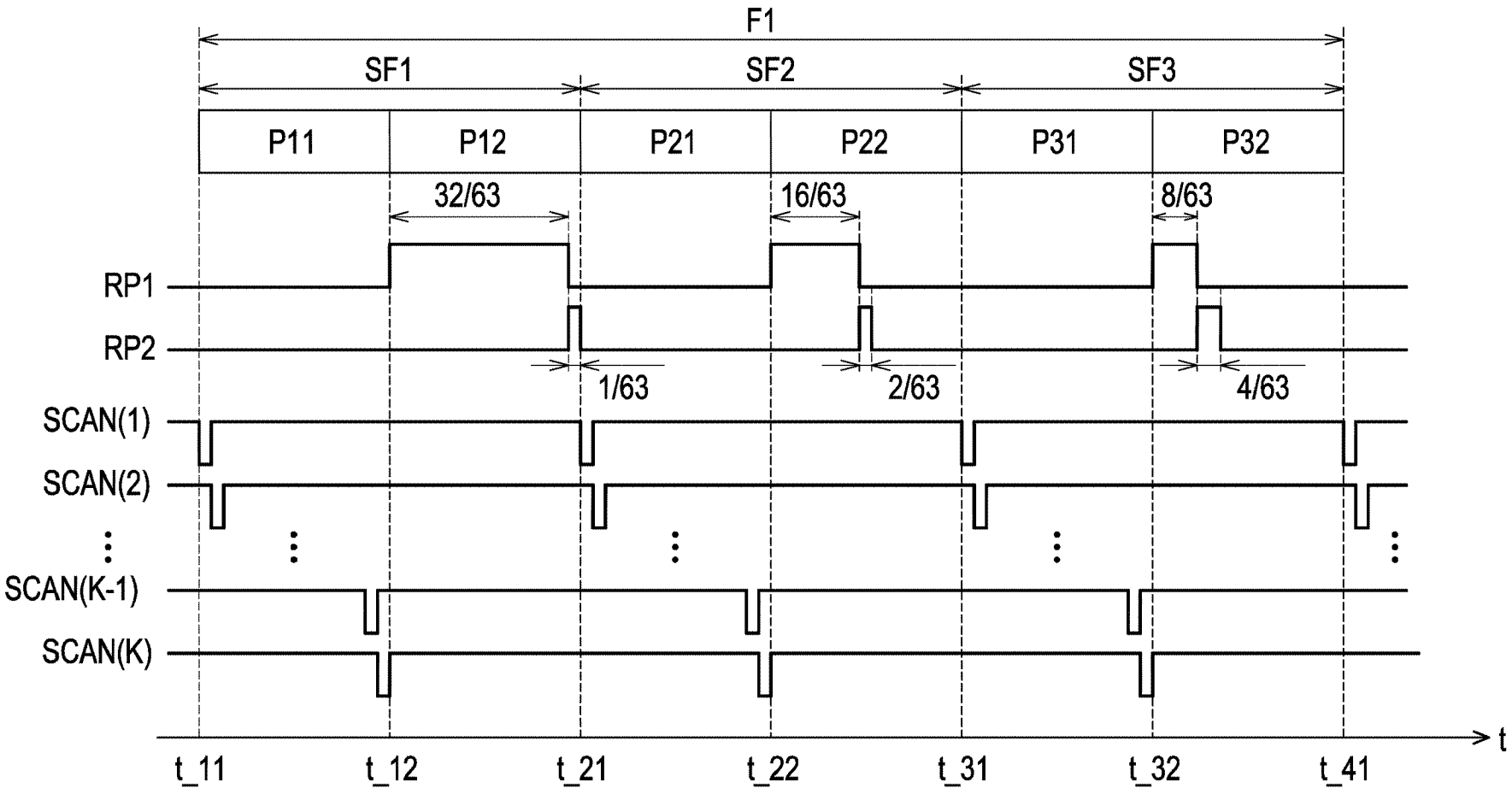
FIG. 3 is a schematic signal timing chart according to first embodiment of the disclosure.

FIG. 3 is a schematic signal timing chart according to an embodiment of the disclosure. Referring to FIG. 1A to FIG. 3, N is assumed to be 3 and M is assumed to be 2, but the disclosure is not limited thereto. That is, each of the K sub-pixels P_1~P_K is configured to display a grayscale during a frame F1 and the frame F1 may include 3 sub-frames SF1~SF3. Each of the 3 sub-frames SF1~SF3 may respectively include scan periods P11, P21, P31 and respectively include emission periods P12, P22, P32.

Specifically, during the scan periods P11, P21, P31, the current control circuit 121 of each of the K sub-pixels P_1~P_K is configured to receive the analog signal DT_A and the scan signal SCAN during the scan period P11, P21, P31. In the embodiment, the scan signal SCAN may include scan signals SCAN(1), SCAN(2), . . . SCAN(K-1), and SCAN(K). The scan signals SCAN(1), SCAN(2), . . . SCAN(K-1), and SCAN(K) are provided to the $1^{st}$ sub-pixel P_1, the $2^{nd}$ sub-pixel, . . . , the $(K-1)^{th}$ sub-pixel, and the $K^{th}$ sub-pixel P_K, respectively. For example, at times t_11, t_21, t_31, t_41, the scan signal SCAN(1) is provided to the $1^{st}$ sub-pixel P_1. Before time t_12, t_22, t_32, the $K^{th}$ scan signal SCAN(K) is provided to the $K^{th}$ sub-pixel P_K. Further, the current control circuit 121 is configured to output the driving current I_D according to the analog signal DT_A during the emission period P12, P22, P32. That is, the amount of the driving current I_D may be determined by the analog signal DT_A. During the emission periods P12, P22, P32, the PWM circuit 122 is configured to output a PWM pulse P_PWM according to the two digital signals DT_D1, DT_D2 and the two reference pulse signals RP1, RP2. That is, the width of the PWM pulse P_PWM may be determined by the two digital signals DT_D1, DT_D2 and the two reference pulse signals RP1, RP2. In this manner, a variety of grayscales may be formed according to a plurality of combinations of the amount of the driving current I_D and the width of the PWM pulse P_PWM. Therefore, as the requirement of levels of grayscales increases, the scale of the driving circuit remains relatively small.

For example, the width of the pulse width P_PWM of 1 is assumed to be used to display a highest grayscale. That is, when the width of the pulse width P_PWM is 1, a gamma value of the grayscale may be 255 for a 256-level grayscale display. When the width of the pulse width P_PWM is 0, a gamma value of the grayscale may be 0 for a 256-level grayscale display. In the embodiment, the width of the PWM pulse P_PWM may be determined by the width of the reference pulse of reference pulse signals RP1, RP2.

In the embodiment, during the emission periods P12, P22, P32, each of the emission periods P12, P22, P32 may include two separated reference pulse according to the two reference pulse signal RP1, RP2, respectively. For example, the emission period P12 may include a reference pulse with a width of 32/63 and a reference pulse with a width of 1/63. The emission period P22 may include a reference pulse with a width of 16/63 and a reference pulse with a width of 2/63. The emission period P32 may include a reference pulse with a width of 8/63 and a reference pulse with a width of 4/63. In the embodiment, a sub-grayscale is defined as a grayscale of each of sub-frames SF1, SF2, SF3. In the embodiment, the summation of the widths of the reference pulse is 1 (32/63+16/63+8/63+4/63+2/63+1/63=63/63). Therefore, a grayscale with gamma value of 1 is formed by a superimposition of the sub-grayscales of one sub-pixel during the emission periods P12, P22, P32. By changing the widths of the reference pulse during the emission periods P12, P22, P32, different grayscales are provided. In other words, the reference pulse signals RF1, RF2 during different emission periods P12, P22, P32 of each of the sub-frames SF1, SF2, SF3 may correspond to different PWM pulses P_PWM. In this manner, a variety of grayscales may be formed according to a plurality of combinations of the amount of the driving current I_D and the width of the PWM pulse P_PWM. Therefore, as the requirement of levels of grayscales increases, the scale of the driving circuit remains relatively small.

In the embodiment, a PWM signal is defined as a combination of the PWM pulses P_PWM corresponding to each of the emission periods P12, P22, P32 of the frame F1. In the embodiment, the PWM circuit 122 may output the N×M bits of PWM signals corresponding to one single frame F1. That is, the reference pulse signals RF1, RF2 may correspond to different PWM pulses P_PWM during different emission periods P12, P22, P32 of the sub-frames SF1, SF2, SF3. For example, during the emission period P12, the PWM pulses P_PWM may correspond to a PWM pulse P_PWM with width of 32/63 according to the reference pulse of reference pulse signal RP1 with width of 32/63. During the emission period P22, the PWM pulses P_PWM may correspond to a PWM pulse P_PWM with width of 16/63 according to the reference pulse of reference pulse signal RP1 with width of 16/63. During the emission period P32, the PWM pulses P_PWM may correspond to a PWM pulse P_PWM with width of 8/63 according to the reference pulse of reference pulse signal RP1 with width of 8/63. It should be noted that the width of the reference pulses is not limited thereto.

In one embodiment, one of the reference pulse signal RP1 and another one of the reference pulse signal RP2, corresponding to a same one of the emission periods P12, P22, P32, may correspond to a longest one of the plurality of PWM pulses P_PWM and a shortest one of the PWM pulses P_PWM, respectively. For example, during the emission period P12, a PWM pulses P_PWM may correspond to a PWM pulse P_PWM with a longest width of 32/63 according to the reference pulse of reference pulse signal RP1 with a longest width of 32/63. Further, a PWM pulses P_PWM may correspond to a PWM pulse P_PWM with a shortest width of 1/63 according to the reference pulse of reference pulse signal RP2 with a shortest width of 1/63. It should be noted that the width of the reference pulses is not limited thereto.

Figure 4:
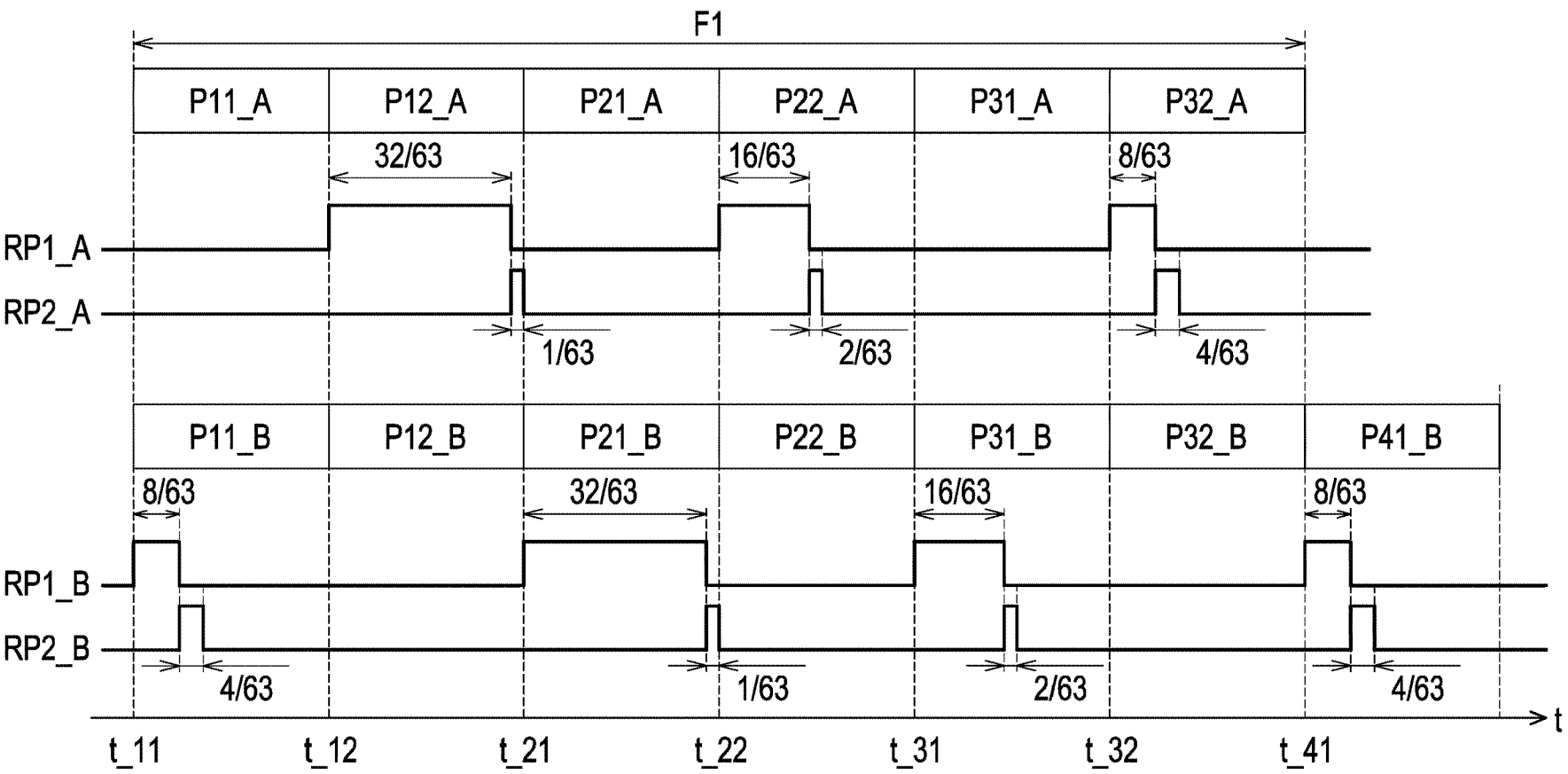
FIG. 4 is a schematic signal timing chart according to second embodiment of the disclosure.

FIG. 4 is a schematic signal timing chart according to an embodiment of the disclosure. Referring to FIG. 1A, FIG. 1B, and FIG. 4, in the embodiment, the plurality of sub-pixels P_1~P_K include two sub-pixels 110 arranged adjacently along a row direction. Further, the sequences of the scan periods P11_A, P21_A, P31_A, P12_B, P22_B, P32_B and the emission periods P12_A, P22_A, P32_A, P11_B, P21_B, P31_B corresponding to the two sub-pixels 110 are different. Specifically, the two sub-pixels 110 may correspond to reference pulse signals RP1_A, RP2_A and reference pulse signals RP1_B, RP2_B, respectively. For example, from time t_11 to time t_12, the reference pulse signals RP1_A, RP2_A may correspond to the scan period P11_A and the reference pulse signals RP1_B, RP2_B may correspond to the PWM period P11_B. That is, the scan periods P11_A, P21_A, P31_A may correspond to the emission periods P11_B, P21_B, P31_B, P41_B. The emission periods P12_A, P22_A, P32_A may correspond to the scan periods P12_B, P22_B, P32_B.

In another embodiment, the plurality of sub-pixels P_1~P_K include two sub-pixels 110 arranged adjacently along a column direction. Further, the sequences of the scan periods P11_A, P21_A, P31_A, P12_B, P22_B, P32_B and the emission periods P12_A, P22_A, P32_A, P11_B, P21_B, P31_B corresponding to the two sub-pixels 110 are different. Specifically, the two sub-pixels 110 may correspond to reference pulse signals RP1_A, RP2_A and reference pulse signals RP1_B, RP2_B, respectively. For example, from time t_11 to time t_12, the reference pulse signals RP1_A, RP2_A may correspond to the scan period P11_A and the reference pulse signals RP1_B, RP2_B may correspond to the PWM period P11_B. That is, the scan periods P11_A, P21_A, P31_A may correspond to the emission periods P11_B, P21_B, P31_B, P41_B. The emission periods P12_A, P22_A, P32_A may correspond to the scan periods P12_B, P22_B, P32_B.

Figure 5A:
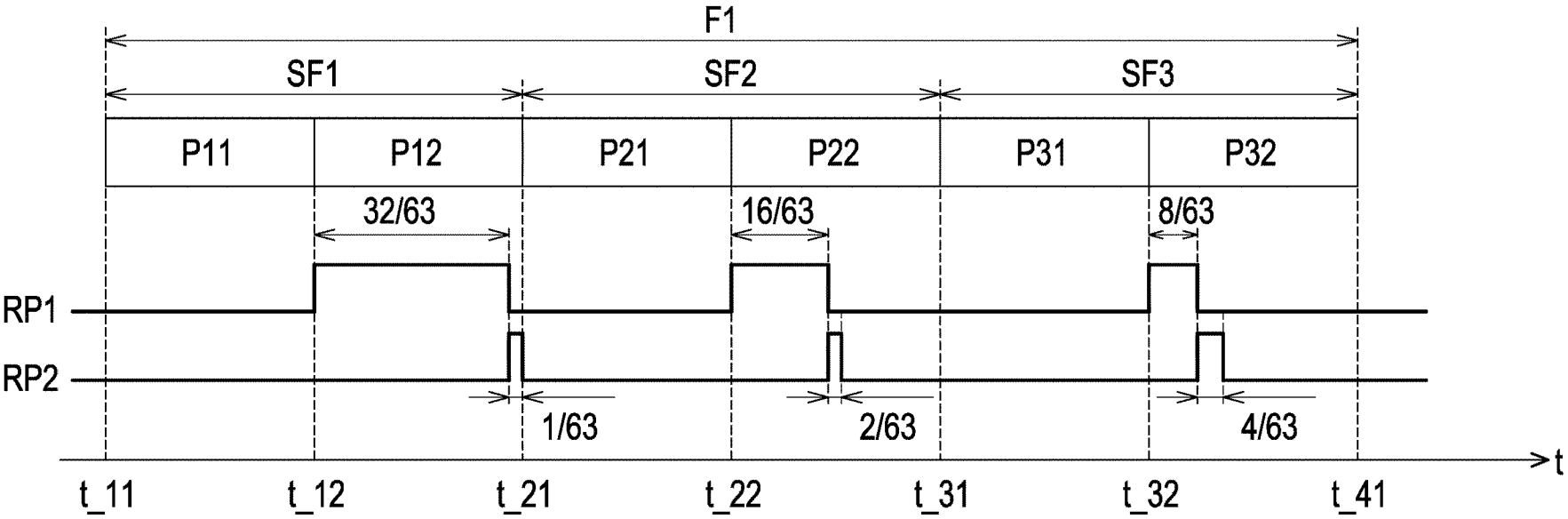
FIG. 5A is a schematic signal timing chart according to third embodiment of the disclosure.
Figure 5B:
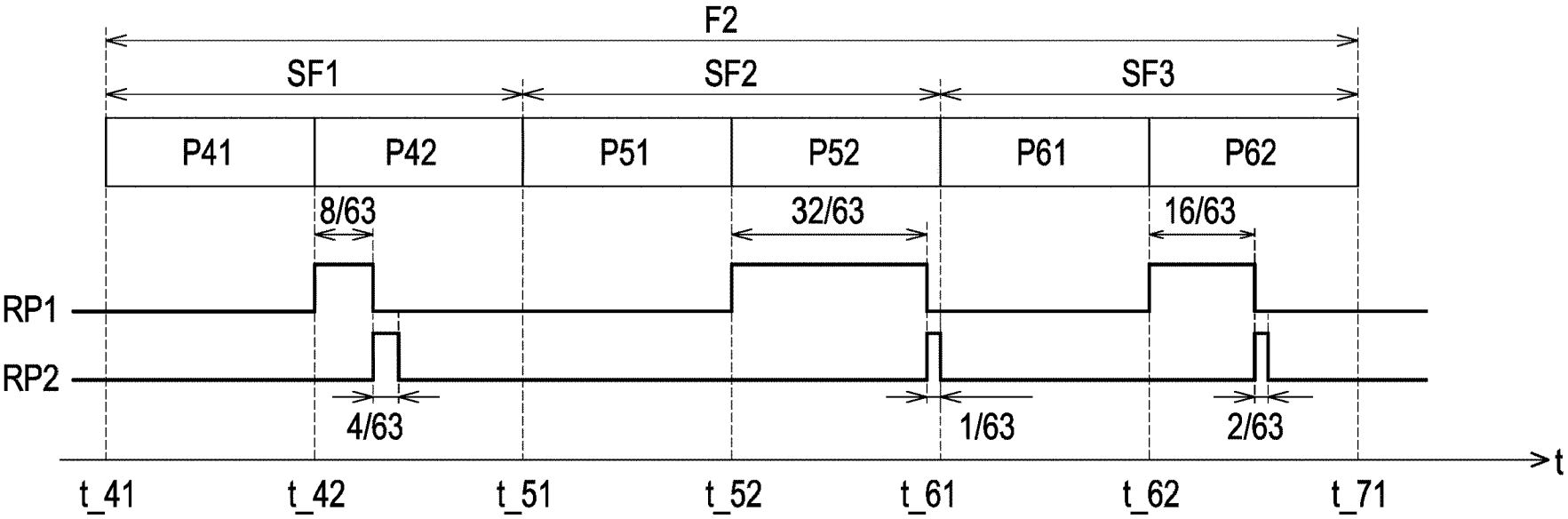
FIG. 5B is a schematic signal timing chart according to third embodiment of the disclosure.
Figure 5C:
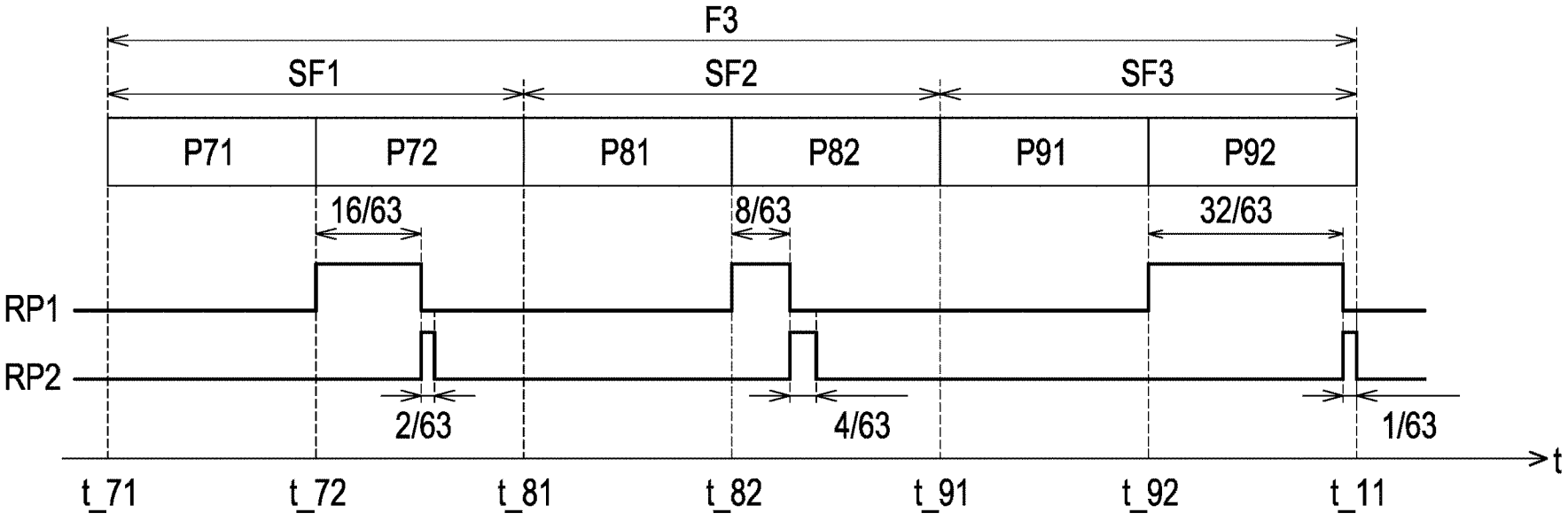
FIG. 5C is a schematic signal timing chart according to third embodiment of the disclosure.

FIG. 5A is a schematic signal timing chart according to third embodiment of the disclosure. FIG. 5B is a schematic signal timing chart according to third embodiment of the disclosure. FIG. 5C is a schematic signal timing chart according to third embodiment of the disclosure. Referring to FIGS. 1A-1B and 5A-5C, FIG. 5A-5C are corresponding to three successive frames F1~F3 of each of the sub-pixels P_1~P_K. That is, the emission period P32 of the frame F1 may end at time t_41 and the scan period of the frame F2 may start at time t_41. The emission period P62 of the frame F2 may end at time t_71 and the scan period of the frame F3 may start at time t_71. Specifically, the scan periods P11, P21, P31, P41, P51, P61, P71, P81, P91 may start at times t_11, t_21, t_, t_31, t_41, t_51, t_61, t_71, t_81, t_91, respectively. The emission periods P12, P22, P32, P42, P52, P62, P72, P82, P92 may start at times t_12, t_22, t_32, t_42, t_52, t_62, t_72, t_82, t_92, respectively.

Referring to FIG. 5A, during the frame F1, the emission period P12 may include a reference pulse with a width of 32/63 and a reference pulse with a width of 1/63. The emission period P22 may include a reference pulse with a width of 16/63 and a reference pulse with a width of 2/63. The emission period P32 may include a reference pulse with a width of 8/63 and a reference pulse with a width of 4/63. In the embodiment, the sequence of the reference pulses during the frame F1 is defined as a pattern A.

Referring to FIG. 5B, during the frame F2, the emission period P42 may include a reference pulse with a width of 8/63 and a reference pulse with a width of 4/63. The emission period P52 may include a reference pulse with a width of 32/63 and a reference pulse with a width of 1/63. The emission period P62 may include a reference pulse with a width of 16/63 and a reference pulse with a width of 2/63. In the embodiment, the sequence of the reference pulses during the frame F2 is defined as a pattern B.

Referring to FIG. 5C, during the frame F3, the emission period P72 may include a reference pulse with a width of 16/63 and a reference pulse with a width of 2/63. The emission period P82 may include a reference pulse with a width of 8/63 and a reference pulse with a width of 4/63. The emission period P92 may include a reference pulse with a width of 32/63 and a reference pulse with a width of 1/63. In the embodiment, the sequence of the reference pulses during the frame F3 is defined as a pattern C.

TABLE 1

| | SF1 | | SF2 | | SF3 | |
|---|---|---|---|---|---|---|
| | RP1 | RP2 | RP1 | RP2 | RP1 | RP2 |
| Pattern A | 32 | 1 | 16 | 2 | 8 | 4 |
| Pattern B | 8 | 4 | 32 | 1 | 16 | 2 |
| Pattern C | 16 | 2 | 8 | 4 | 32 | 1 |

Referring to table 1 as shown above, the patterns A, B, C may include similar reference pulses signals RP1, RP2 with different sequences of the reference pulses, but this disclosure is not limited thereto. That is, at least one of the reference pulse signals RP1, RP2 has different PWM pulse sequences during the emission periods corresponding to successive two of the sub-frames SF1, SF2, SF3. In one embodiment, the patterns A, B, C may include completely different reference pulse signals.

Figure 6A:
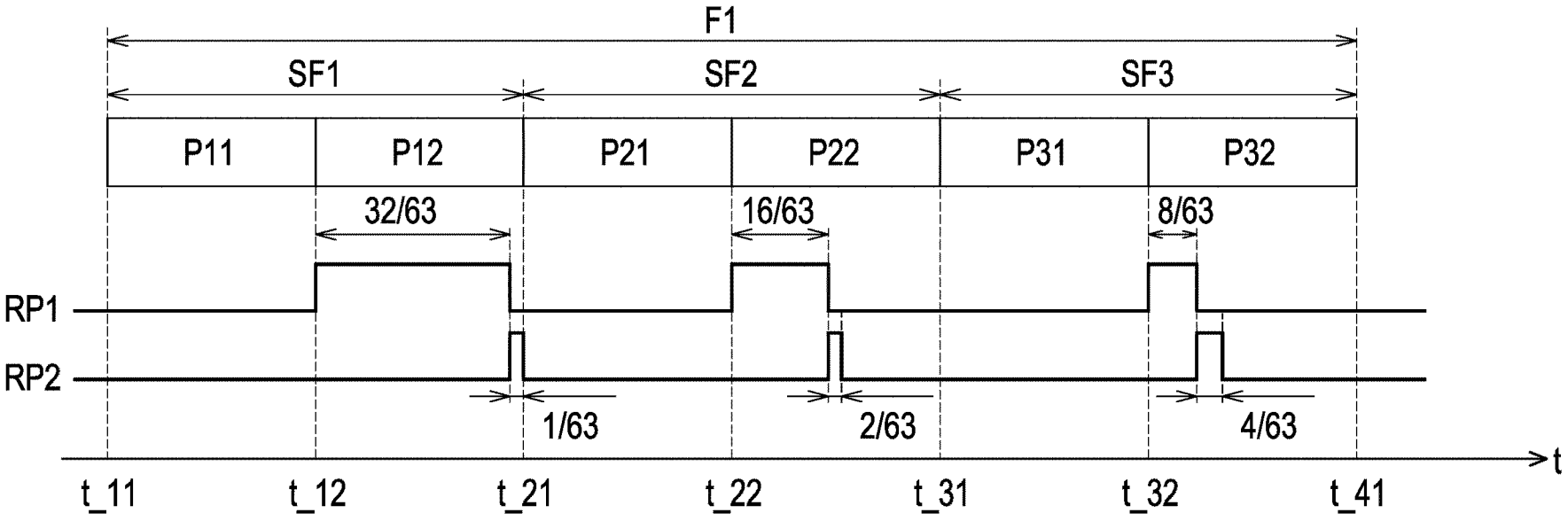
FIG. 6A is a schematic signal timing chart according to fourth embodiment of the disclosure.
Figure 6B:
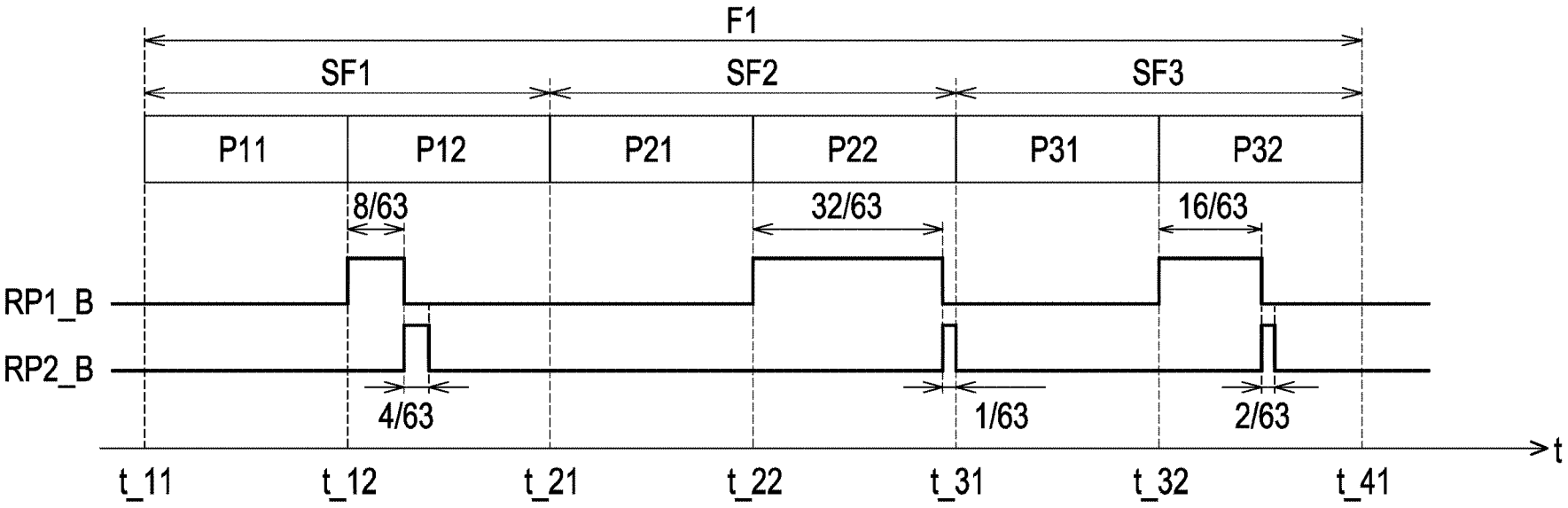
FIG. 6B is a schematic signal timing chart according to fourth embodiment of the disclosure.
Figure 6C:
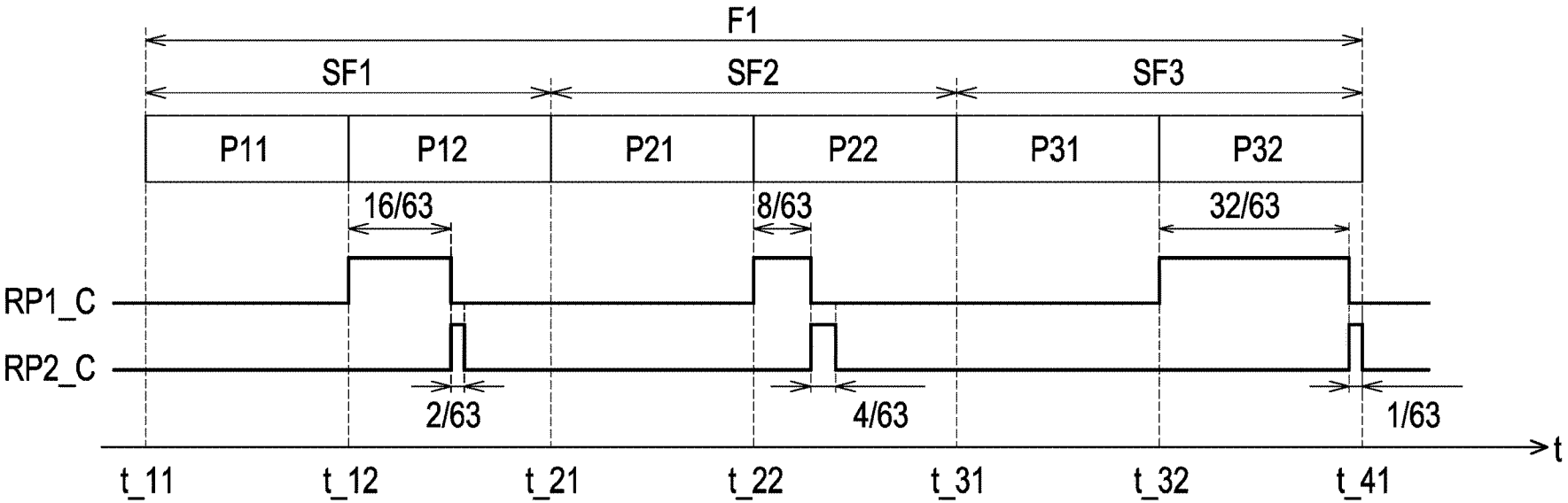
FIG. 6C is a schematic signal timing chart according to fourth embodiment of the disclosure.

FIG. 6A is a schematic signal timing chart according to fourth embodiment of the disclosure. FIG. 6B is a schematic signal timing chart according to fourth embodiment of the disclosure. FIG. 6C is a schematic signal timing chart according to fourth embodiment of the disclosure. FIG. 6D is a schematic sub-pixels arrangement according to fourth embodiment of the disclosure. FIG. 6E is a schematic sub-pixels arrangement according to fourth embodiment of the disclosure. FIG. 6F is a schematic sub-pixels arrangement according to fourth embodiment of the disclosure. Referring to FIG. 1A, FIG. 5A to FIG. 6D and table 1, the K sub-pixels P_1~P_K may be arranged in a form of matrix. The difference of the third embodiment and the fourth embodiment is that the patterns of the third embodiment differ from one frame to another frame, but the patterns of the fourth embodiment differ from one sub-pixel 110 to another sub-pixel 110.

Specifically, a plurality of sub-pixels 110 arranged adjacently along a row direction may include a same pattern of the sequence of the reference pulse. For example, a row of the sub-pixels 110 may include a pattern A of the reference pulse. Further, a row of the sub-pixels 110 next to the row of the sub-pixels 110 including a pattern A of the reference pulse may include a pattern B of the reference pulse. Furthermore, a row of the sub-pixels 110 next to the row of the sub-pixels 110 including a pattern B of the reference pulse may include a pattern C of the reference pulse. In this manner, the arrangement of the sub-pixel may be arranged repetitively to form a matrix. In the embodiment, the matrix is formed by a plurality of sub-pixels 110 with patterns A, B, C. However, the disclosure is not limited thereto.

Referring to FIG. 1A, FIG. 5A to FIG. 6C, FIG. 6E and table 1, the K sub-pixels P_1~P_K may be arranged in a form of matrix. In the embodiment, a plurality of sub-pixels 110 arranged adjacently along a column direction may include a same pattern of the sequence of the reference pulse. For example, a column of the sub-pixels 110 may include a pattern A of the reference pulse. Further, a column of the sub-pixels 110 next to the column of the sub-pixels 110 including a pattern A of the reference pulse may include a pattern B of the reference pulse. Furthermore, a column of the sub-pixels 110 next to the column of the sub-pixels 110 including a pattern B of the reference pulse may include a pattern C of the reference pulse. In this manner, the arrangement of the sub-pixel may be arranged repetitively to form a matrix. In the embodiment, the matrix is formed by a plurality of sub-pixels 110 with patterns A, B, C. However, the disclosure is not limited thereto.

Referring to FIG. 1A, FIG. 5A to FIG. 6C, FIG. 6F and table 1, the K sub-pixels P_1~P_K may be arranged in a form of matrix. The patterns of the plurality of sub-pixels 110 may be arranged repetitively in a sequence of patterns A, B, and C in either along the row direction or along the column direction. In the embodiment, the matrix is formed by a plurality of sub-pixels 110 with patterns A, B, C. However, the disclosure is not limited thereto.

Figure 7C:
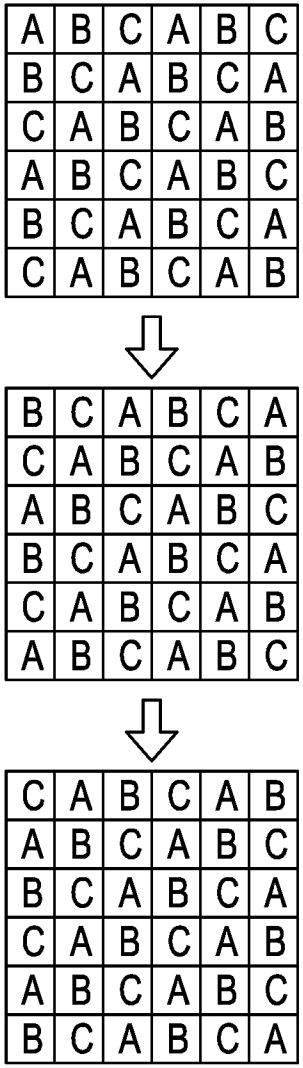
FIG. 7C is a schematic sub-pixels arrangement according to fifth embodiment of the disclosure.
Figure 7B:
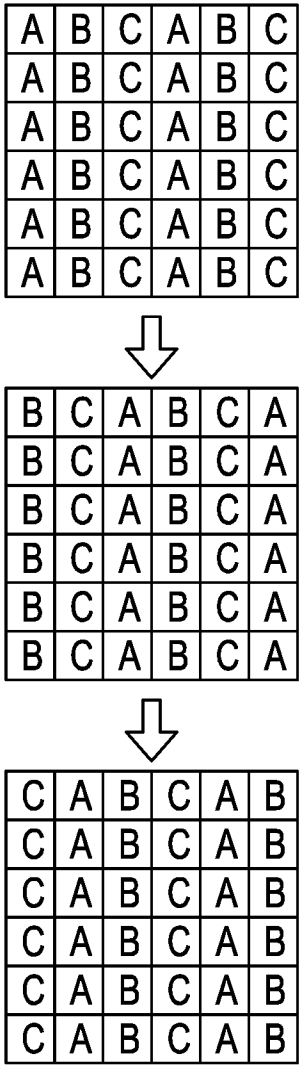
FIG. 7B is a schematic sub-pixels arrangement according to fifth embodiment of the disclosure.
Figure 7A:
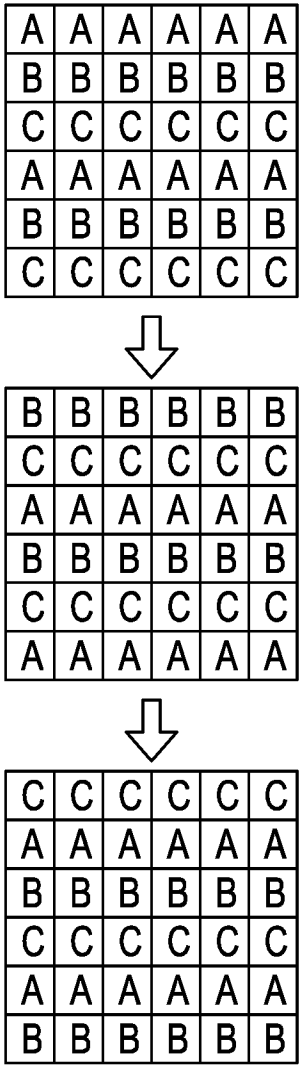
FIG. 7A is a schematic sub-pixels arrangement according to fifth embodiment of the disclosure.

FIG. 7A is a schematic sub-pixels arrangement according to fifth embodiment of the disclosure. FIG. 7B is a schematic sub-pixels arrangement according to fifth embodiment of the disclosure. FIG. 7C is a schematic sub-pixels arrangement according to fifth embodiment of the disclosure. Referring to FIG. 1A, FIG. 5A to FIG. 7C and table 1, the K sub-pixels P_1~P_K may be arranged in a form of matrix. The difference of the fifth embodiment and the third and fourth embodiment is that the patterns of the fifth embodiment differ not only from one frame to another frame, but also differ from one sub-pixel 110 to another sub-pixel 110. In other words, the fifth embodiment is a combination of the third embodiment and the fourth embodiment.

Specifically, referring to FIG. 1A, FIG. 5A to FIG. 6D, FIG. 7A and table 1, during the frame F1, a plurality of sub-pixels 110 arranged adjacently along a row direction may include a same pattern of the sequence of the reference pulse. For example, a row of the sub-pixels 110 may include a pattern A of the reference pulse. Further, a row of the sub-pixels 110 next to the row of the sub-pixels 110 including a pattern A of the reference pulse may include a pattern B of the reference pulse. Furthermore, a row of the sub-pixels 110 next to the row of the sub-pixels 110 including a pattern B of the reference pulse may include a pattern C of the reference pulse. In this manner, the arrangement of the sub-pixel may be arranged repetitively to form a matrix. During the frame F2 after F1, the patterns of the plurality of sub-pixels 110 are shifted one row along the column direction. That is, the pattern of each of the plurality of sub-pixels 110 during the frame F2 is different from the pattern of each of the plurality of sub-pixels 110 during the frame F1. Similarly, during the frame F3 after F2, the patterns of the plurality of sub-pixels 110 are shifted one row along the column direction. That is, the pattern of each of the plurality of sub-pixels 110 during the frame F3 is different from the pattern of each of the plurality of sub-pixels 110 during the frame F2. In other words, the patterns of the plurality of sub-pixels 110 differ not only from one frame to another frame, but also differ from one sub-pixel 110 to another sub-pixel 110. In the embodiment, the matrix is formed by a plurality of sub-pixels 110 with patterns A, B, C. However, the disclosure is not limited thereto.

Referring to FIG. 1A, FIG. 5A to FIG. 6C, FIG. 6E, FIG. 7B and table 1, during the frame F1, a plurality of sub-pixels 110 arranged adjacently along a column direction may include a same pattern of the sequence of the reference pulse. For example, a column of the sub-pixels 110 may include a pattern A of the reference pulse. Further, a column of the sub-pixels 110 next to the column of the sub-pixels 110 including a pattern A of the reference pulse may include a pattern B of the reference pulse. Furthermore, a column of the sub-pixels 110 next to the column of the sub-pixels 110 including a pattern B of the reference pulse may include a pattern C of the reference pulse. In this manner, the arrangement of the sub-pixel may be arranged repetitively to form a matrix. During the frame F2 after F1, the patterns of the plurality of sub-pixels 110 are shifted one column along the row direction. That is, the pattern of each of the plurality of sub-pixels 110 during the frame F2 is different from the pattern of each of the plurality of sub-pixels 110 during the frame F1. Similarly, during the frame F3 after F2, the patterns of the plurality of sub-pixels 110 are shifted one column along the row direction. That is, the pattern of each of the plurality of sub-pixels 110 during the frame F3 is different from the pattern of each of the plurality of sub-pixels 110 during the frame F2. In other words, the patterns of the plurality of sub-pixels 110 differ not only from one frame to another frame, but also differ from one sub-pixel 110 to another sub-pixel 110. In the embodiment, the matrix is formed by a plurality of sub-pixels 110 with patterns A, B, C. However, the disclosure is not limited thereto.

Referring to FIG. 1A, FIG. 5A to FIG. 6C, FIG. 6F, FIG. 7C and table 1, the K sub-pixels P_1~P_K may be arranged in a form of matrix. During the frame F1, the patterns of the plurality of sub-pixels 110 may be arranged repetitively in a sequence of patterns A, B, and C in either along the row direction or along the column direction. During the frame F2 after F1, the patterns of the plurality of sub-pixels 110 are shifted one column along the row direction or shifted one row along the column direction. That is, the pattern of each of the plurality of sub-pixels 110 during the frame F2 is different from the pattern of each of the plurality of sub-pixels 110 during the frame F1. During the frame F3 after F2, the patterns of the plurality of sub-pixels 110 are shifted one column along the row direction or shifted one row along the column direction. That is, the pattern of each of the plurality of sub-pixels 110 during the frame F3 is different from the pattern of each of the plurality of sub-pixels 110 during the frame F2. In other words, the patterns of the plurality of sub-pixels 110 differ not only from one frame to another frame, but also differ from one sub-pixel 110 to another sub-pixel 110. In the embodiment, the matrix is formed by a plurality of sub-pixels 110 with patterns A, B, C. However, the disclosure is not limited thereto.

Figure 8:
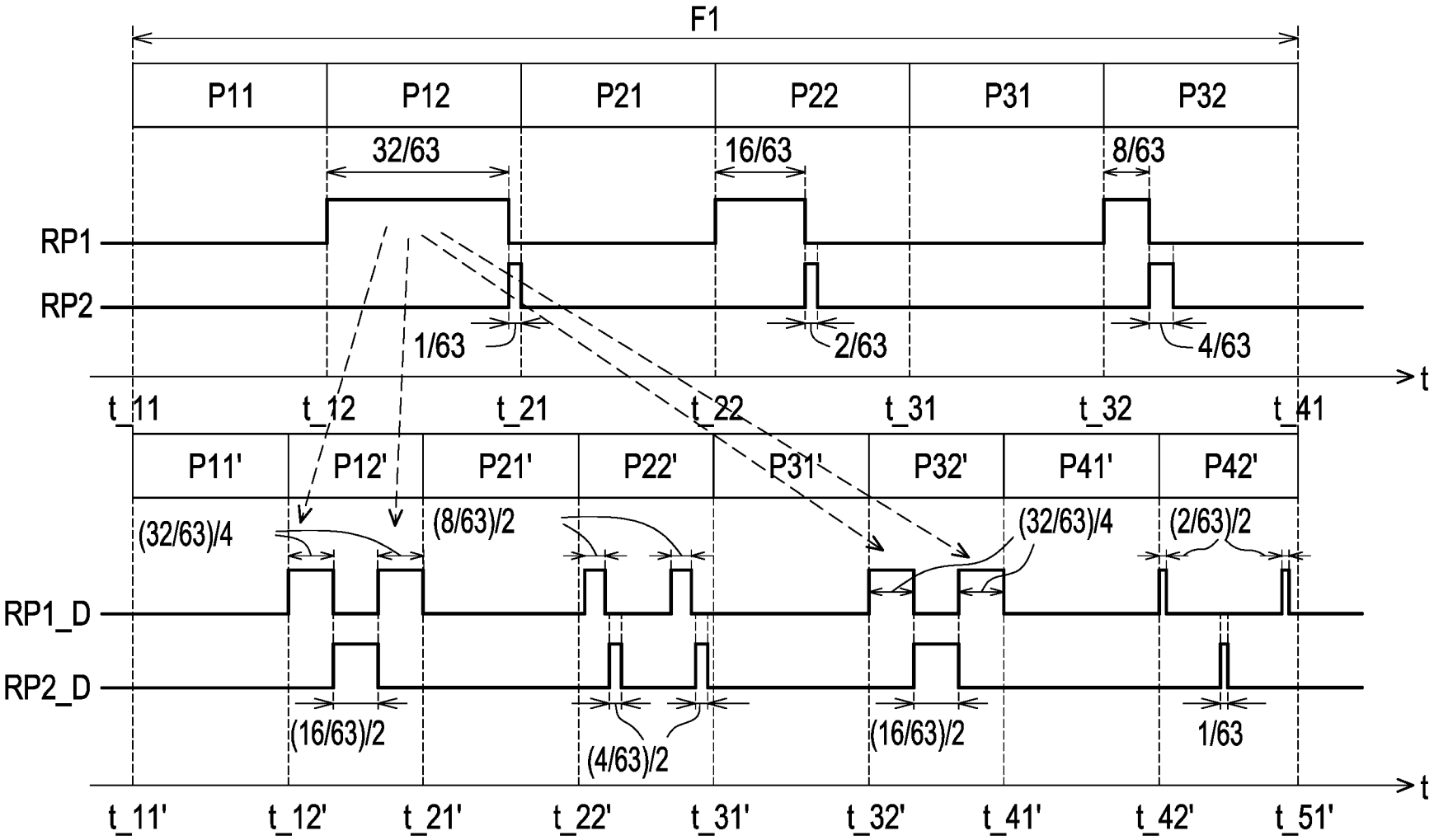
FIG. 8 is a schematic signal timing chart according to sixth embodiment of the disclosure.

FIG. 8 is a schematic signal timing chart according to sixth embodiment of the disclosure. Referring to FIG. 1A, FIG. 1B, FIG. 3 and FIG. 8, the difference of the first embodiment and the sixth embodiment is that each of the emission periods P12, P22, P32 include one reference pulse according to each of the reference pulse signals RP1, RP2 in the first embodiment, but each of the emission periods P12', P22', P32', P42' include one reference pulse or more than one reference pulses according to each of the reference pulse signals RP1, RP2 in the sixth embodiment.

Specifically, the upper half part of FIG. 8 is same as FIG. 3 and the lower half part of FIG. 8 depicts the main idea of the sixth embodiment. Referring to the upper half part of FIG. 8, the frame F1 may include three scan periods P11, P21, P31 and three emission periods P12, P22, P32. That is, the scan periods P11, P21, P31 may start at times t_11, t_21, t_31, respectively. The emission periods P12, P22, P32 may start at times t_12, t_22, t_32, respectively. A new cycle of the three scan periods P11, P21, P31 and three emission periods P12, P22, P32 starts at time t_41. In the embodiment, each of the emission periods P12, P22, P32 may include one reference pulse according to each of the reference pulse signals RP1, RP2 and the summation of the widths of the reference pulses is 1 (32/63+16/63+8/63+4/63+2/63+1/63=63/63).

Referring to the lower half part of FIG. 8, the frame F1 may include four scan periods P11', P21', P31', P41' and four emission periods P12', P22', P32', P42'. That is, the scan periods P11', P21', P31', P41' may start at times t_11', t_21', t_31', t_41', respectively. The emission periods P12', P22', P32', P42' may start at times t_12', t_22', t_32', t_42', respectively. A new cycle of the three scan periods P11', P21', P31', P41' and three emission periods P12', P22', P32', P42' starts at time t_51'. In the embodiment, each of the emission periods P12', P22', P32', P42' may include one reference pulse or more than one reference pulses according to each of the reference pulse signals RP1_D, RP2_D. For example, as the arrow shown in FIG. 8, the reference pulse with width of 32/63 according to the reference pulse signal RP1 during the emission period P12 may be divided into four reference pulses with width (32/63)/4, e.g., 8/63, according to the reference pulse signal RP1__D during the emission periods P12' and P32'. Similarly, other reference pulse according to the reference pulse signals RP1, RP2 during the emission periods P12, P22, P32 may remain the same width or be divided into more than one reference pulses according to the reference pulse signals RP1_D, RP2__D during the emission periods P12', P22', P32', P42'. In other words, at least one of the reference pulse signals RP1_D, RP2_D may include two PWM pulses separated in time during a same one or different ones of the emission periods P12', P22', P32', P42'. In the embodiment, the reference pulse with width of 32/63 during the emission P12 may be divided into four reference pulses during two different emission periods P12', P32'. Further, the reference pulse with width of 16/63 during the emission P22 may be divided into two reference pulses during a same emission period P22'. It is noted that the summation of the widths of the reference pulse is still 1 ((32/63)/4×4+(16/63)/2×2+(8/63)/2×2+(4/63)/2×2+(2/63)/2×2+1/63=63/63). Therefore, a grayscale displayed by a sub-pixel 110 according to the reference pulse signals RP1_D, RP2_D may be same as a grayscale displayed by a sub-pixel 110 according to the reference pulse signals RP1, RP2.

Figure 9:
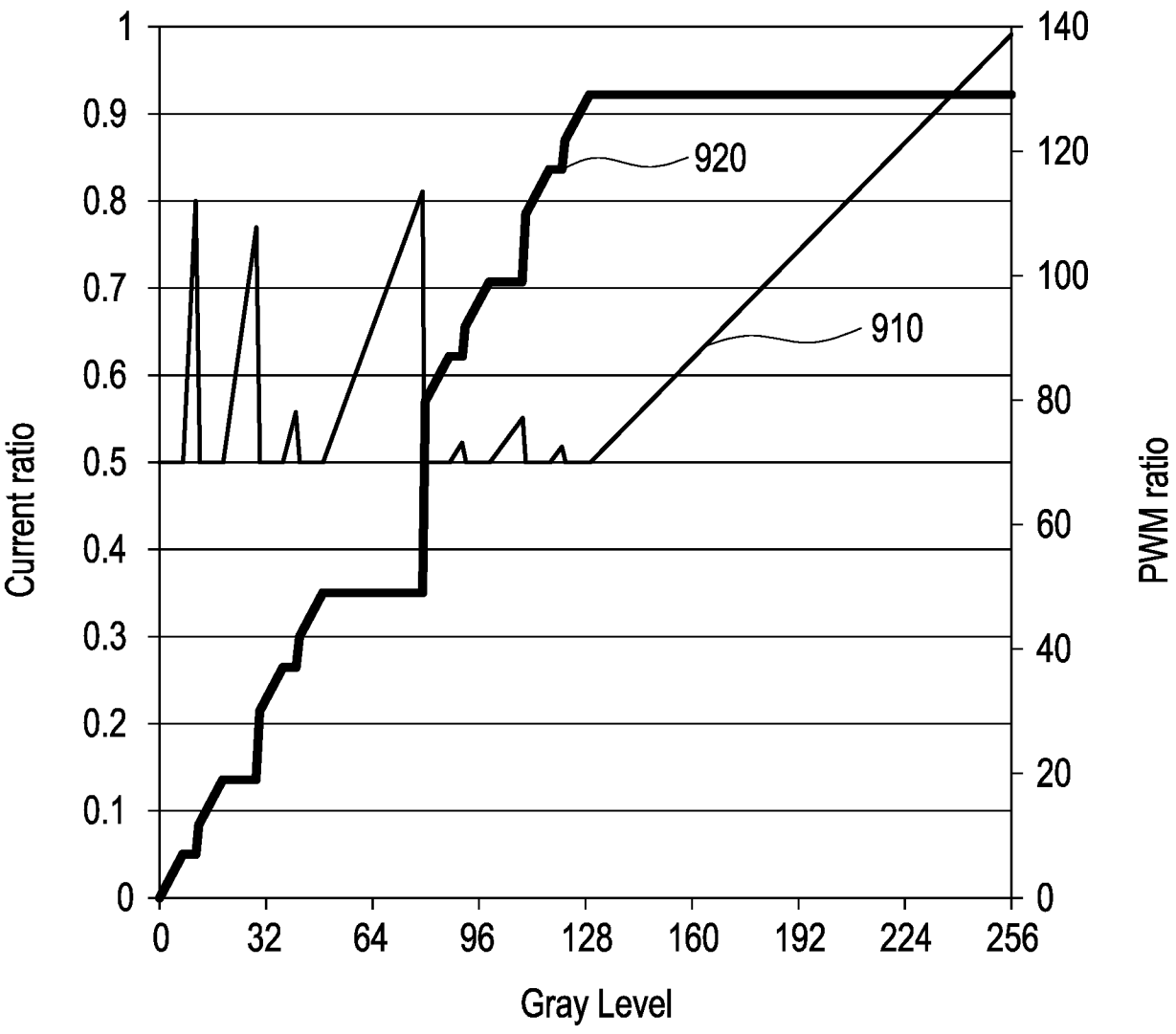
FIG. 9 is a schematic gray level chart according to seventh embodiment of the disclosure.

FIG. 9 is a schematic gray level chart according to seventh embodiment of the disclosure. Referring to FIG. 1B and FIG. 9, the difference of the seventh embodiment and the first to sixth embodiment is that only the width of the PWM pulse P_PWM is changed to form a plurality of grayscales in the first to sixth embodiment, but both the amount of the driving current I_D and the width of the PWM pulse P_PWM are changed to form a plurality of grayscales in the seventh embodiment.

For example, for a gamma 1.0 standard with levels of 256, 256 different grayscale may be displayed by the sub-pixel 110. As mentioned beforehand, The PWM circuit 122 may output the N×M bits of PWM signals corresponding to one single frame F1. N is the number of the sub-frames in one frame and M is the number of the reference pulse signals. That is, assuming N to be 3 and M to be 2, a 6-bit data input may be obtained. In other words, a 64-level ($2^6$=64) may be obtained. For example, a bit of 6 may represent a pulse width ratio of 32. A bit of 5 may represent a pulse width ratio of 16. A bit of 4 may represent a pulse width ratio of 8. A bit of 3 may represent a pulse width ratio of 4. A bit of 2 may represent a pulse width ratio of 2. A bit of 1 may represent a pulse width ratio of 1. It is noted that the pulse width ratio is a ratio of the width of a reference pulse to the width of the reference pulse with the shortest width.

However, since a 64-level data input is not enough for gamma 1.0 standard with levels of 256, the amount of the driving current I_D and the width of the PWM pulse P_PWM are further changed to form the 256 grayscales. Specifically, referring to table 2 as shown below, a bit of 6 may represent a pulse width ratio of 80. A bit of 5 may represent a pulse width ratio of 30. A bit of 4 may represent a pulse width ratio of 12. A bit of 3 may represent a pulse width ratio of 4. A bit of 2 may represent a pulse width ratio of 2. A bit of 1 may represent a pulse width ratio of 1. In other words, the pulse width ratios of 6 bits are expanded to represent more numbers of the grayscales. Referring to line 920 of FIG. 9 and table 3 as shown below, the pulse width ratio (PWM ratio) may vary as the grayscale (gray level) varies.

TABLE 2

| bit | 6 | 5 | 4 | 3 | 2 | 1 |
|---|---|---|---|---|---|---|
| Pulse width ratio | 80 | 30 | 12 | 4 | 2 | 1 |

In addition, the amount of the driving current I_D is further adjusted to provide different levels of the amount of the driving current I_D. Specifically, referring to line 910 of FIG. 9, instead of providing the driving current I_D at a fixed value, the driving current I_D (Current ratio) may vary as the grayscale (gray level) varies.

TABLE 3

| | Pulse width ratio (W) | | | | | | Current | Gray Ratio |
|---|---|---|---|---|---|---|---|---|
| Gray level | 80 | 30 | 12 | 4 | 2 | 1 | Ratio (R) | (W × R) |
| 0 | 0 | 0 | 0 | 0 | 0 | 0 | 0.5 | 0 |
| 1 | 0 | 0 | 0 | 0 | 0 | 1 | 0.5 | 0.5 |
| 64 | 0 | 1 | 1 | 1 | 1 | 1 | 0.653 | 32 |
| 128 | 1 | 1 | 1 | 1 | 1 | 0 | 0.5 | 64 |
| 129 | 1 | 1 | 1 | 1 | 1 | 1 | 0.5 | 64.5 |
| 192 | 1 | 1 | 1 | 1 | 1 | 1 | 0.744 | 142.8 |
| 255 | 1 | 1 | 1 | 1 | 1 | 1 | 0.988 | 127.5 |

In this manner, the amount of the driving current I_D and the width of the PWM pulse P_PWM are further changed to form the 256 grayscales. In other words, the 256 grayscales may be represented with a 6-bit data input. Therefore, as the requirement of levels of grayscales increases, the scale of the driving circuit remains relatively small.

For example, referring to FIG. 9 and table 3 as shown above, a gray level of 0 may be represented with a gray ratio of 0 while the pulse width ratio (PWM ratio) is 0 and the current ratio is 0.5. In the embodiment, the minimum value is preferably to be chosen as a value greater than a certain value for accurately controlling the amount of the driving current I_D. Similarly, a gray level of 255 may be represented with a gray ratio of 127.5 while the pulse width ratio (PWM ratio) is 129 (1+2+4+12+30+80=129) and the current ratio is 0.988. That is, the driving current I_D may include a plurality of current levels and the PWM pulse P_PWM may include a plurality of pulse widths. The grayscale may include a plurality of grayscale levels and a number of the grayscale levels may be determined according to the current levels and the pulse widths. It is noted that the number of ratio may be adjusted due to design requirement and this disclosure is not limited thereto.

Figure 10:
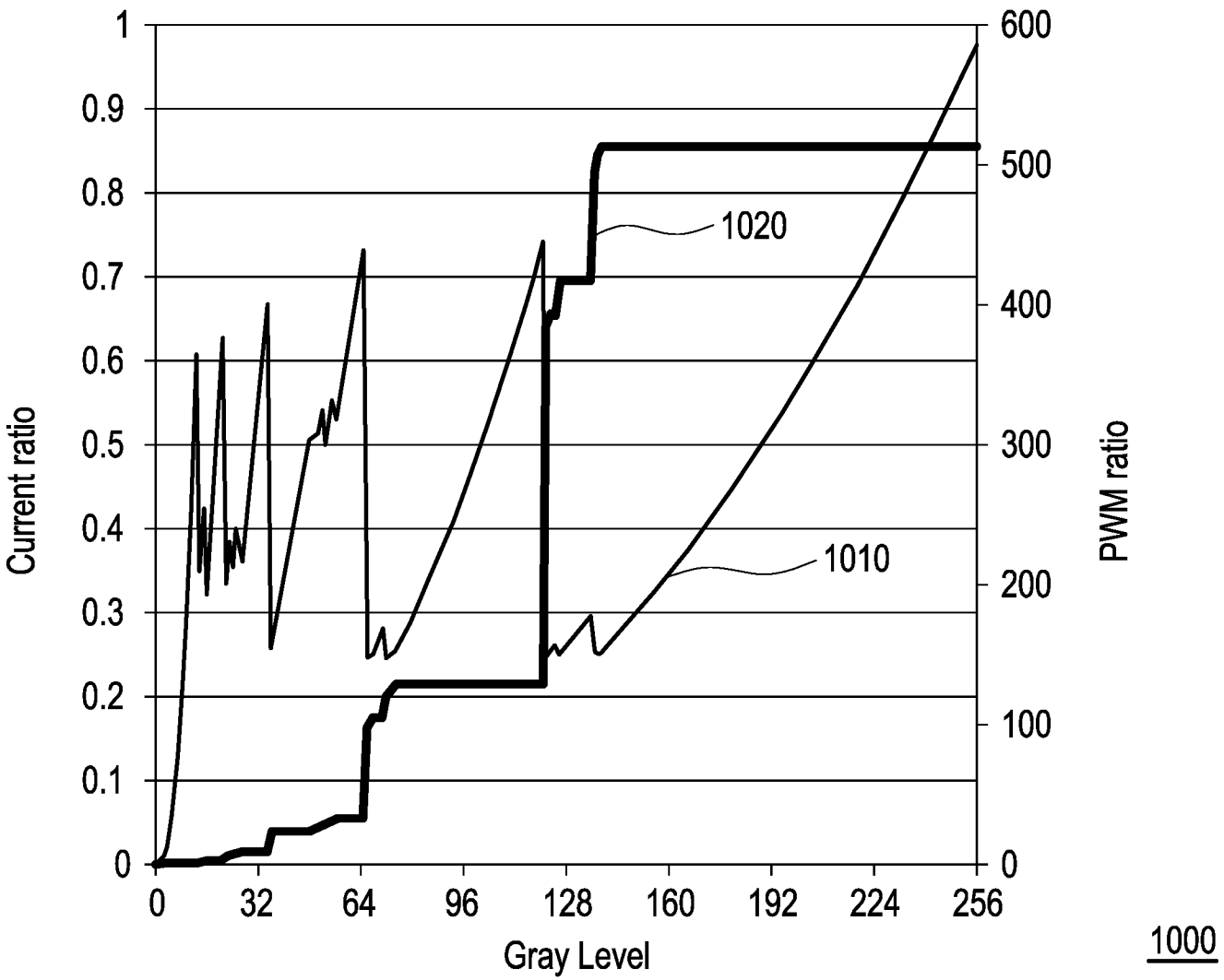
FIG. 10 is a schematic gray level chart according to eighth embodiment of the disclosure.

FIG. 10 is a schematic gray level chart according to eighth embodiment of the disclosure. Referring to FIG. 1B, FIG. 9 and FIG. 10, the difference of the eighth embodiment and the seventh embodiment is that the seventh embodiment is for a gamma 1.0 standard with levels of 256 and the eighth embodiment is for a gamma 2.2 standard with levels of 256. In the embodiment, referring to table as shown below, a bit of 6 may represent a pulse width ratio of 384. A bit of 5 may represent a pulse width ratio of 96. A bit of 4 may represent a pulse width ratio of 24. A bit of 3 may represent a pulse width ratio of 6. A bit of 2 may represent a pulse width ratio of 2. A bit of 1 may represent a pulse width ratio of 1.

TABLE 4

| bit | 6 | 5 | 4 | 3 | 2 | 1 |
|---|---|---|---|---|---|---|
| Pulse width ratio | 384 | 96 | 24 | 6 | 2 | 1 |

Due to the characteristic of the driving current I_D, the adjustment of the width of the reference pulses of the reference pulse signals RP1, RP2 is easier that the adjustment of the amount of the driving current. Therefore, referring to FIG. 10 and table 5 as shown below, the current ratio may remain at a certain value as the grayscale (gray level) varies within certain range. For example, for gray levels of 192 and 255, the current ratio are both 513 (384+96+24+6+2+1=513). That is, the changes of the gray level of 192 to gray level of 255 may be contributed by the adjustment of the pulse width ratio. However, it is noted that the number of ratio may be adjusted due to design requirement and this disclosure is not limited thereto.

TABLE 5

| | Pulse width ratio (W) | | | | | | Current | Gray Ratio |
|---|---|---|---|---|---|---|---|---|
| Gray level | 384 | 96 | 24 | 6 | 2 | 1 | Ratio (R) | (W × R) |
| 0 | 0 | 0 | 0 | 0 | 0 | 0 | 0 | 0 |
| 1 | 0 | 0 | 0 | 0 | 0 | 1 | 0.003 | 0.003 |
| 16 | 0 | 0 | 0 | 0 | 1 | 1 | 0.377 | 1.131 |
| 32 | 0 | 0 | 0 | 1 | 1 | 1 | 0.578 | 5.202 |
| 64 | 0 | 1 | 1 | 1 | 1 | 1 | 0.724 | 23.89 |
| 128 | 1 | 0 | 1 | 1 | 1 | 1 | 0.263 | 109.7 |

TABLE 5-continued

| | Pulse width ratio (W) | | | | | | Current | Gray Ratio |
|---|---|---|---|---|---|---|---|---|
| Gray level | 384 | 96 | 24 | 6 | 2 | 1 | Ratio (R) | (W × R) |
| 192 | 1 | 1 | 1 | 1 | 1 | 1 | 0.522 | 267.8 |
| 255 | 1 | 1 | 1 | 1 | 1 | 1 | 0.975 | 500.2 |

Figure 11:
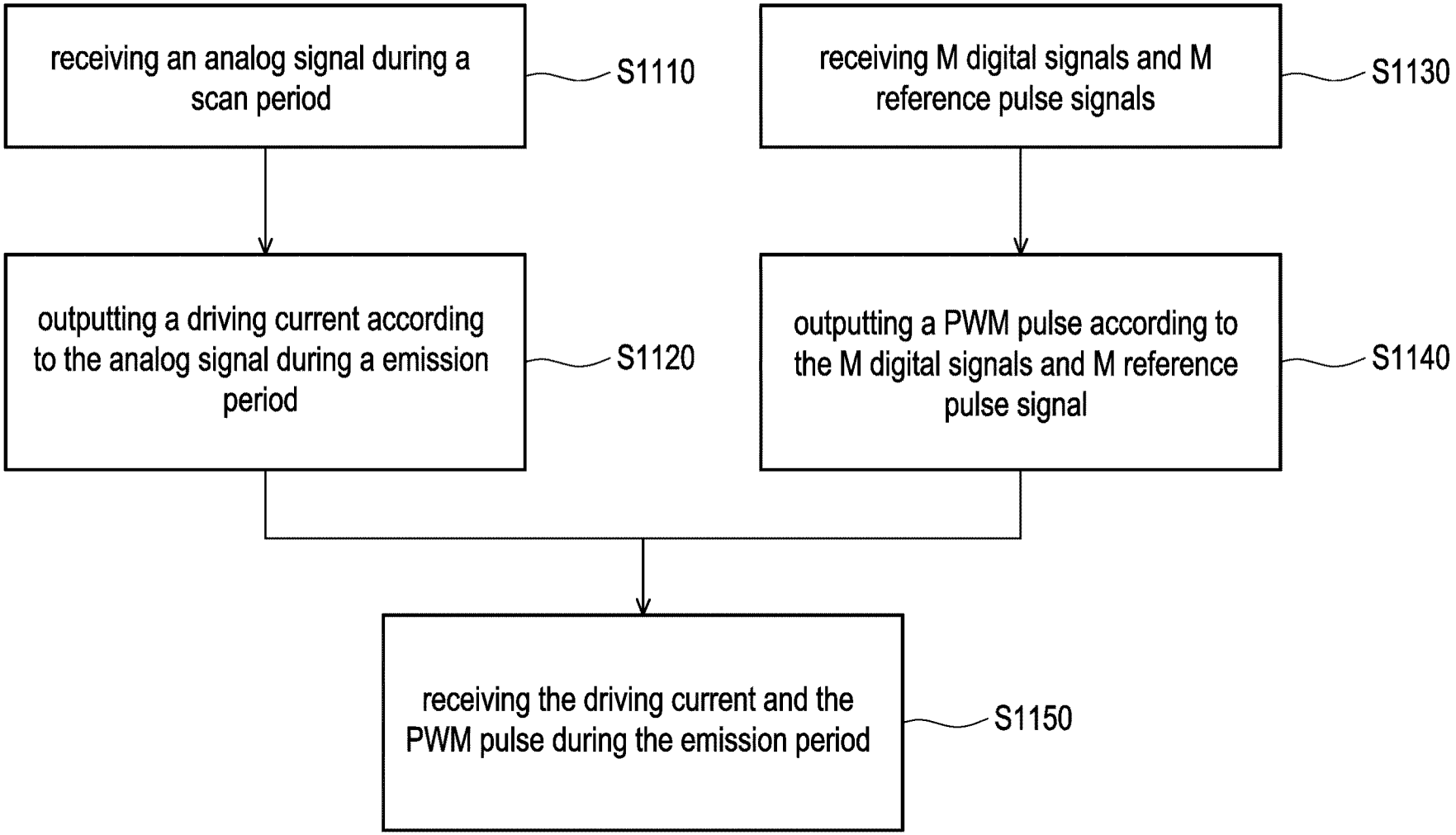
FIG. 11 is a schematic flowchart of a light emitting method according to one embodiment of the disclosure.

FIG. 11 is a schematic flowchart of a light emitting method according to one embodiment of the disclosure. Referring to FIG. 1A to FIG. 3 and FIG. 11, the method of the embodiment of FIG. 11 may be adapted to apply on the light emitting device 100. In step S1110, the current control circuit 121 may receive an analog signal during a scan period. In step S1120, the current control circuit 121 may output a driving current according to the analog signal during an emission period. In step 1130, the PWM circuit 122 may receive M digital signals and M reference pulse signals. In step 1140, the PWM circuit 122 may output a PWM pulse according to the M digital signals and M reference pulse signal. In step 1150, the light emitter 130 may receive the driving current and the PWM pulse during the emission period. Therefore, as the requirement of levels of grayscales increases, the scale of the driving circuit remains relatively small. In the embodiment, the execution sequence of the step S1110 and the step S1130 may be at the same time or at different time, the disclosure is not limited thereto. In addition, the relevant circuit features, implementation details, and related technical features of the light emitting device 100 may obtain sufficient teachings, suggestions, and implementation descriptions based on the description of the above-mentioned embodiments of FIG. 1 to FIG. 10, and there will not repeat again.

In summary, according to the light emitting device and the light emitting method of the disclosure, by the above circuit designs of the current control circuit and the PWM circuit, even if the requirement of levels of grayscales increases, the light emitting device of the disclosure can effectively reduce the scale of pixel circuit and can provide a good grayscale display effective.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A light emitting device, comprising:

a plurality of sub-pixels, wherein each of the sub-pixels is configured to display a grayscale during a frame, wherein the frame comprises N sub-frames and N is an integer greater than 1, and each of the sub-frames comprises a scan period and an emission period, wherein each of the sub-pixels comprises:

a pixel circuit, comprises:

a current control circuit, configured to receive an analog signal during the scan period, and configured to output a driving current according to the analog signal during the emission period; and a pulse width modulation (PWM) circuit, configured to receive M digital signals and M reference pulse signals, and configured to output a PWM pulse according to the M digital signals and the M reference pulse signals, wherein M is an integer greater than 1; and a light emitter, configured to receive the driving current and the PWM pulse during the emission period of each of the N sub-frames, wherein a PWM signal is a combination of the PWM pulses corresponding to each of the emission periods of the frame, and the PWM circuit outputs the N×M bits of PWM signals corresponding to one frame.

2. The light emitting device according to claim 1, wherein the reference pulse signals during different emission periods of each of the sub-frames comprise different PWM pulses.

3. The light emitting device according to claim 2, wherein one of the reference pulse signals and another one of the reference pulse signals respectively comprise a longest PWM pulse and a shortest PWM pulse during a same one of the emission periods.

4. The light emitting device according to claim 1, wherein at least one of the reference pulse signals has different PWM pulse sequences during the emission periods corresponding to successive two of the sub-frames.

5. The light emitting device according to claim 1, wherein the plurality of sub-pixels comprises two sub-pixels arranged adjacently along a row direction or a column direction, and the reference pulse signals corresponding to the two sub-pixels during a same frame are different.

6. The light emitting device according to claim 5, wherein each of the reference pulse signals has different PWM pulse sequences during the emission periods corresponding to successive two of the sub-frames.

7. The light emitting device according to claim 1, wherein at least one of the reference pulse signals comprises two PWM pulses separated in time during different emission periods or a same one of the emission periods.

8. The light emitting device according to claim 1, wherein the PWM circuit comprises M AND gates and a NOR gate, the NOR gate is coupled to the M AND gates, the M AND gates are configured to respectively receive the M digital signals and to respectively receive the M reference pulse signals.

9. The light emitting device according to claim 1, wherein the plurality of sub-pixels comprises two sub-pixels arranged adjacently along a row direction or a column direction, and sequences of the scan periods and the emission periods corresponding to the two sub-pixels are different.

10. A light emitting device, comprising:

a plurality of sub-pixels, wherein each of the sub-pixels is configured to display a grayscale during a frame, wherein the frame comprises N sub-frames and N is an integer greater than 1, and each of the sub-frames comprises a scan period and an emission period, wherein each of the sub-pixels comprises:

a pixel circuit, comprises:

a current control circuit, configured to receive an analog signal during the scan period, and configured to output a driving current according to the analog signal during the emission period; and a pulse width modulation (PWM) circuit, configured to receive M digital signals and M reference pulse signals, and configured to output a PWM pulse according to the M digital signals and the M reference pulse signals, wherein M is an integer greater than 1; and a light emitter, configured to receive the driving current and the PWM pulse during the emission period of each of the N sub-frames, wherein the driving current comprises a plurality of current levels, the PWM pulse comprises a plurality of pulse widths, and the grayscale comprises a plurality of grayscale levels, wherein a number of the grayscale levels is determined according to the current levels and the pulse widths.

11. A light emitting method, adapted to a light emitting device, wherein the light emitting device comprises a plurality of sub-pixels, a current control circuit, a pulse width modulation (PWM) circuit, and a light emitter, wherein each of the sub-pixels is configured to display a grayscale during a frame, the frame comprises N sub-frames and N is an integer greater than 1, and each of the sub-frames comprises a scan period and an emission period, wherein the light emitting method comprises:

receiving, through the current control circuit, an analog signal during the scan period;

outputting, through the current control circuit, a driving current according to the analog signal during the emission period;

receiving, through the PWM circuit, M digital signals and M reference pulse signals, wherein M is an integer greater than 1;

outputting, through the PWM circuit, a PWM pulse according to the M digital signals and the M reference pulse signals; and receiving, by the light emitter, the driving current and the PWM pulse during the emission period of each of the N sub-frames, wherein the driving current comprises a plurality of current levels, the PWM pulse comprises a plurality of pulse widths, and the grayscale comprises a plurality of grayscale levels, wherein a number of the grayscale levels is determined according to the current levels and the pulse widths.

12. The light emitting method according to claim 11, wherein the reference pulse signals during different emission periods of each of the sub-frame correspond to different PWM pulses.

13. The light emitting method according to claim 11, wherein one of the reference pulse signals and another one of the reference pulse signals respectively comprise a longest PWM pulse and a shortest PWM pulse during same one of the emission periods.

14. The light emitting method according to claim 11, wherein at least one of the reference pulse signals has different PWM pulse sequences during the emission periods corresponding to successive two of the sub-frames.

15. The light emitting method according to claim 11, wherein the plurality of sub-pixels comprises two sub-pixels arranged adjacently along a row direction or a column direction, and the reference pulse signals corresponding to the two sub-pixels during a same frame are different.

16. The light emitting method according to claim 15, wherein each of the reference pulse signals has different PWM pulse sequences during the emission periods corresponding to successive two of the sub-frames.

17. The light emitting method according to claim 11, wherein at least one of the reference pulse signals comprises two PWM pulses separated in time during different emission periods or a same one of the emission periods.

18. The light emitting method according to claim 11, wherein the plurality of sub-pixels comprises two sub-pixels arranged adjacently along a row direction or a column direction, and sequences of the scan periods and the emission periods corresponding to the two sub-pixels are different.

* * * * *